US006747404B2

(12) United States Patent
Rha

(10) Patent No.: US 6,747,404 B2
(45) Date of Patent: Jun. 8, 2004

(54) FLAT TYPE FLUORESCENT LAMP AND METHOD FOR MANUFACTURING THE SAME

(75) Inventor: Sa Kyun Rha, Daejon-Kwangyokshi (KR)

(73) Assignees: LG.Philips LCD Co., Ltd., Seoul (KR); Sangnong Enterprise Co., Ltd., Seoul (KR); Young Jong Lee, Daejon-Kwangyokshi (KR)

( * ) Notice: Subject to any disclaimer, the term of this patent is extended or adjusted under 35 U.S.C. 154(b) by 152 days.

(21) Appl. No.: 09/893,553

(22) Filed: Jun. 29, 2001

(65) Prior Publication Data

US 2002/0079828 A1 Jun. 27, 2002

(30) Foreign Application Priority Data

Dec. 22, 2000 (KR) ..... 2000-80212

(51) Int. Cl.[7] ..... H01J 1/62

(52) U.S. Cl. ..... 313/491; 313/484; 313/485; 313/631; 313/309; 313/336; 313/351

(58) Field of Search ..... 313/491, 484, 313/495–497, 485, 631, 309, 336, 351, 471, 422, 514, 517, 522; 445/46, 49; 315/169.1, 169.3, 169.4

(56) References Cited

U.S. PATENT DOCUMENTS 5,216,324 A * 6/1993 Curtin ..... 313/495
5,834,885 A * 11/1998 Itoh et al. ..... 313/336
6,008,576 A * 12/1999 Nakatani et al. ..... 313/495
6,153,973 A * 11/2000 Shibata et al. ..... 313/495
6,222,317 B1 * 4/2001 Vollkommer et al. ..... 313/485
6,259,198 B1 * 7/2001 Yanagisawa et al. ..... 313/495
6,281,621 B1 * 8/2001 Nakamoto et al. ..... 313/497

* cited by examiner

*Primary Examiner*—Nimeshkumar D. Patel
*Assistant Examiner*—Sharlene Leurig
(74) *Attorney, Agent, or Firm*—Morgan, Lewis & Bockius LLP

(57) ABSTRACT

A flat type fluorescent lamp that serves as an illuminating unit and a back light of a large sized liquid crystal panel. The flat type fluorescent lamp includes a first substrate, a second substrate, a first electrode formed on the first substrate, the first electrode including a plurality of protrusions, a phosphor layer formed on the second substrate, a second electrode formed on the phosphor layer, and supports selectively formed between the first substrate and the second substrate. A method for manufacturing a flat type fluorescent lamp comprising the steps of forming a first electrode with protrusions at different intervals on a first substrate, forming a barrier layer over an entire surface of the first substrate including the first electrode, forming a phosphor layer on a second substrate, forming a second electrode on the phosphor layer, selectively forming supports between the first substrate and the second substrate and bonding the first substrate to the second substrate.

12 Claims, 6 Drawing Sheets

FLAT TYPE FLUORESCENT LAMP AND METHOD FOR MANUFACTURING THE SAME

The present invention claims the benefit of Korean Patent Application No. 2000-80212 filed in Korea on Dec. 22, 2000, which is hereby incorporated by reference.

BACKGROUND OF THE INVENTION

1. Field of the Invention

The present invention relates to a flat type fluorescent lamp, and more particularly, to a flat type fluorescent lamp and a method for manufacturing the same.

2. Discussion of the Related Art

A back light used as a light source of a liquid crystal display (LCD) panel is created by an arrangement using a cylindrical fluorescent lamp. Such a back light can be a direct type or a light-guiding plate type.

In the direct type back light, the fluorescent lamp is mounted under the LCD panel. The shape of the fluorescent lamp can be seen on the display of the LCD panel due to unequal distribution of luminous intensity across the LCD panel if the fluorescent lamp is too close to the LCD panel. Therefore, it is necessary to maintain a distance between the fluorescent lamp and the LCD panel to enable a uniform distribution of luminous intensity across the LCD panel. Inherently, there is a minimum thickness limitation when attempting to form a thin size back light using a direct type back light.

In the light-guiding plate type, the fluorescent lamp is mounted outside LCD panel so that light is diverted to be dispersed uniformly across the back surface of the LCD panel using a light-guiding plate having printed dots. In this case, since the fluorescent lamp is mounted at one side and light passing through a side of the light-guiding plate has to be diverted so as to disperse the light across the LCD panel, a problem arises in that luminance is low. Also, for uniform distribution of luminous intensity, advanced optical design with regard to the dot pattern and processing technologies to maintain design dimensions are required.

FIG. 1 is a sectional view of a related art back light, and FIG. 2 is an exploded perspective view of a related art back light. In FIGS. 1 and 2, a light-guiding plate type back light is shown in which linear light emitted from a lamp 10 is diverted so as to disperse across the LCD panel.

A portion of the related art back light is positioned under a back surface of a liquid crystal panel that displays an image. As shown in FIG. 1, the related art back light includes a main support 1 for supporting respective elements. In a portion of the main support 1 that will be positioned outside of the LCD panel that displays an image, the respective elements include a lamp assembly 10 used as a light source and a lower cover 3 for covering the main support 1. In another portion of the main support 1 that will be under a back surface of the LCD panel that the respective elements include a reflector 4 positioned on the main support 1 for reflecting light into the LCD panel, a light-guiding plate 5 for uniformly supplying light irradiated from the lamp to the LCD panel, a lower light-diffusion plate 6 provided on an upper surface of the light-guiding plate 5 to diffuse the light emitted from the light-guiding plate 5, a lower prism 7 provided on an upper surface of the lower light diffusion plate 6 for condensing the light emitted from the lower light-diffusion plate 6, an upper prism 8 for further condensing light emitted from the lower prism 7 and an upper light-diffusion plate 9 provided on an upper surface of the upper prism 8 to diffuse light emitted from the upper prism 8 into the LCD panel.

An assembly process of the aforementioned related art back light will now be described with reference to FIG. 2.

As shown in FIG. 2, spacers 14 are provided on the lamp to protect the lamp 11. Then a high pressure lamp wire 13*a* connected to a connector 16 and a low pressure lamp wire 13*b* are respectively soldered to a high pressure side and a low pressure side of the lamp 11. Lamp holders 12*a* and 12*b* are assembled to cover a soldering portion of the lamp so that the lamp holders 12*a* and 12*b* are mounted in a lamp housing 15. Thus, a lamp assembly 10 is completed.

Subsequently, the lamp assembly 10 is positioned on the main support 1 and the lower cover 3 is attached to the main support 1 so that the lamp assembly is not damaged by external impact. Thereafter, a reflecting plate 4 is mounted on an inner surface of the main support 1 and a light-guiding plate 5 is mounted in an inner gap of the lamp housing 15 so as not to deform the gap size and flatness of the lamp housing 15. Afterwards, the lower light-diffusion plate 6, the lower prism 7, the upper prism 8, and the upper light-diffusion plate 9 are sequentially formed on the light-guiding plate 5.

In such a related art back light, if the connector 16 is connected with a power supply to apply power to the lamp, a glow discharge occurs in the lamp, thereby emitting light. The emitted light is entered into a light incident surface of the light-guiding plate 5. The light is then diverted by the light-guiding plate 5 using dots in a predetermined pattern within the light-guiding plate 5 and condensed in a vertical direction while passing through the prisms 7 and 8. The light can scatter at oblique angles while passing through the light-diffusion plates 6 and 9. Therefore, some of the light passes through the light-diffusion plates and illuminates the back surface of the LCD panel. The reflecting plate 4 serves to upwardly reflect through the light-guiding plate 5 the light that is directed downward due do the scattering of the light-diffusion plates 6 and 9.

However, the related art back light has several problems. First, since the light is emitted from the side of the support using a cylindrical fluorescent lamp as a light source, it is difficult for the fluorescent lamp to generate a large amount of luminance across the entire surface of the main support that is under the back surface of an LCD panel.

Second, since the light-guiding plate uses dots in a predetermined pattern to upwardly divert the light entered from the side, it is difficult to appropriately control a surface state of the light-guiding plate and direction of light with the dot pattern.

Third, the related art back light requires various elements in an exact dimensional relationship with one another. For example, the light-guiding plate may be bent so as to no longer maintain the proper dimension with the light source or the bottom surface of the LCD panel. Particularly, deformation may occur due to the difference of expansion coefficient between sheet elements and other elements at a high temperature. The dimensional change of the light-guiding plate having greater absorption than the main support is a serious problem. In case of a notebook computer, deformation of the light-guiding plate may occur when folding and unfolding the notebook computer.

Fourth, the related art back light manufacturing process is complex, thereby reducing yield. Strict process management is required so as not to generate foreign materials that scratch the light-guiding plate, reflector, prisms or diffusers.

In addition, it is impossible to assemble the fluorescent lamp using automated equipment, which increases the manufacturing cost due to labor costs. Furthermore, quality control is difficult to manage.

SUMMARY OF THE INVENTION

Accordingly, the present invention is directed to a flat type fluorescent lamp and a method for manufacturing the same that substantially obviates one or more of the problems due to limitations and disadvantages of the related art.

An object of the present invention is to provide a flat type fluorescent lamp that serves as an illuminating unit and a back light of a large sized liquid crystal panel.

Another object of the present invention is to provide a flat type fluorescent lamp that can be manufactured using an automated system to simplify parts sourcing and process steps, thereby improving yield and reducing the manufacturing cost.

Another object of the present invention is to provide a flat type fluorescent lamp and a method for manufacturing the same in which plasmas, formed between a plurality of cathodes and anodes, create a plurality of white dot light sources for a back light of an LCD panel having uniform high luminance.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a flat type fluorescent lamp according to the present invention includes a first substrate, a second substrate, a first electrode formed on the first substrate, the first electrode including a plurality of protrusions, a phosphor layer formed on the second substrate, second electrodes formed on the phosphor layer, and supports selectively formed between the first substrate and the second substrate.

In another aspect, a method for manufacturing a flat type fluorescent lamp according to the present invention includes the steps of forming a first electrode with protrusions at different intervals on a first substrate, forming a barrier layer over an entire surface of the first substrate including the first electrode, forming a phosphor layer on a second substrate, forming a second electrode on the phosphor layer, selectively forming supports between the first substrate and the second substrate and bonding the first substrate to the second substrate.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Reference will now be made in detail to the preferred embodiments of the present invention, examples of which are illustrated in the accompanying drawings.

Figure 1:
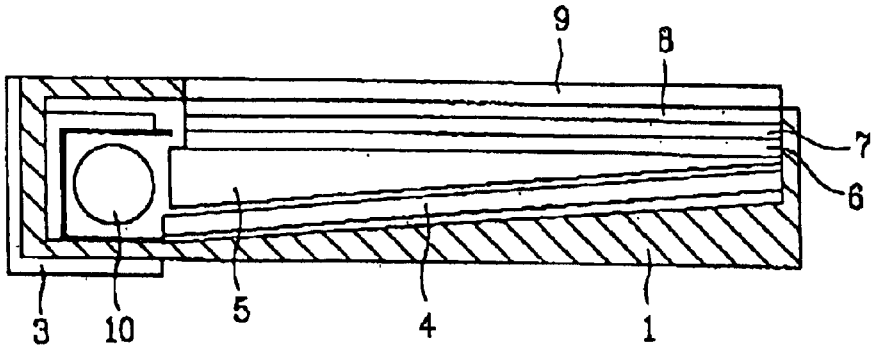
FIG. 1 Related Art
FIG. 1 is a sectional view of a related art back light.
Figure 2:
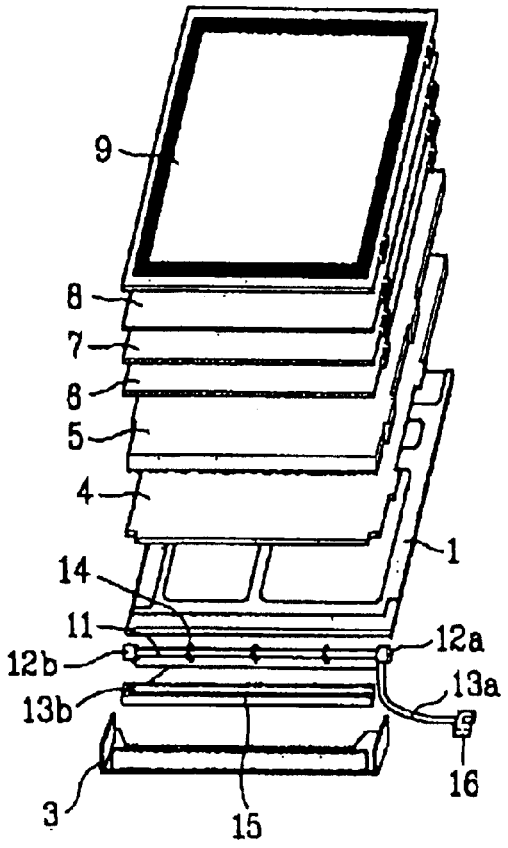
FIG. 2 Related Art
FIG. 2 is an exploded perspective view of a related art back light.
Figure 3:
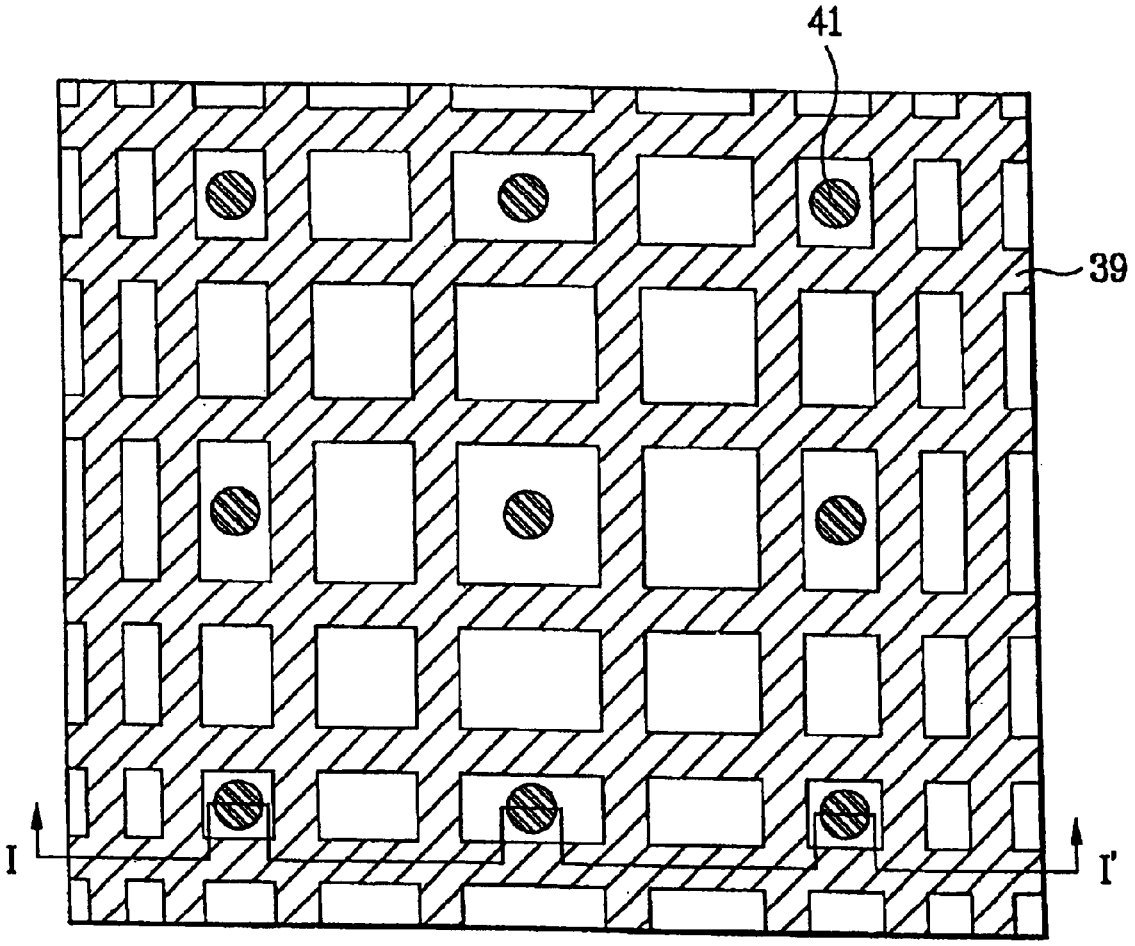
FIG. 3 is a plan view of a flat type fluorescent lamp according to the present invention.
Figure 4:
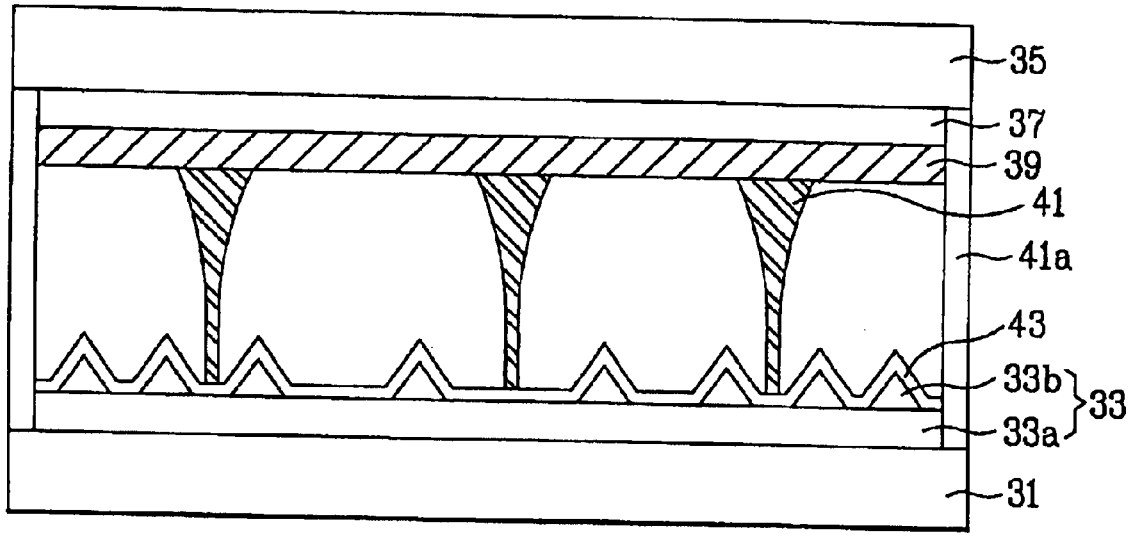
FIG. 4 is a sectional view taken along line I–I' of FIG. 3.

FIG. 3 is a plane view of a flat type fluorescent lamp according to the present invention, and FIG. 4 is a sectional view taken along line I–I' of FIG. 3.

As shown in FIGS. 3 and 4, the flat type fluorescent lamp according to the present invention includes a first electrode 33 comprised of a first metal layer 33*a* and a plurality of metal protrusions 33*b* formed on a first substrate 31. A barrier layer 43 covers the first metal layer 33*a* and the plurality of metal protrusions 33*b*. A second substrate 35 has a surface facing the first substrate 31 covered with a phosphor layer 37. A second electrode 39 having a matrix shape is on the phosphor layer 37. Supports 41 are selectively formed between the first substrate 31 and the second substrate 35.

The first metal layer 33*a* is formed on the entire surface of the first substrate 31 and the metal protrusions 33*b* are selectively formed on the first metal layer 33*a*. The metal protrusions 33*b* are formed on portions of the first metal layer 33*a* that corresponds to areas of the second electrode 39 matrix that are directly over the first metal layer 33*a*.

Figure 6A:
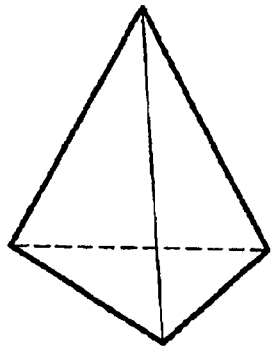
FIGS. 6A to 6C are sectional views illustrating exemplary embodiments of a metal protrusions formed on a first electrode according to a flat type fluorescent lamp of the present invention.
Figure 6B:
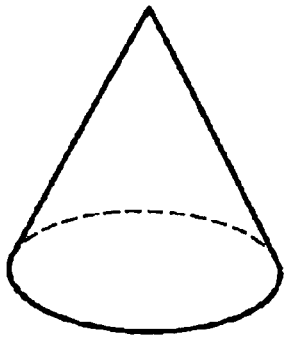
Figure 6C:
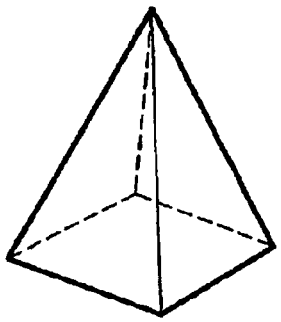

In the one embodiment of the present invention, the metal protrusions 33*b* are formed in a trigonal pyramid shape, as shown in FIG. 6A. However, the metal protrusions 33*b* may have various shapes such as a cone shape, as shown in FIG. 6B, a quadrangular pyramid shape, as shown in FIG. 6C, or any other appropriate shape.

The first substrate 31 and the second substrate 35 are formed of a glass substrate or a heat-resistant flat panel. Alternatively, the first substrate 31 can be formed of a metal or an insulating material.

The barrier layer 43 is comprised of a material that is capable of preventing the first electrode 33 from being damaged by electrons emitted during discharge between the first electrode 33 and the second electrode 39 and at the same time capable of serving as an anti-reflector layer that directs and concentrates ultraviolet (UV) rays in the upward direction toward the second electrode 39 and prevents the UV rays from radiating downward. For example, the barrier layer 43 is formed of any one of AlN, $BaTiO_3$, $SiN_x$, and $SiO_x$.

The first electrode 33 and the second electrode 39 are formed of a metal having low resistivity, for example, Ag, Cr, Pt, or Cu.

Generally, luminance in the periphery of a lamp is lower than that in the center of the lamp. Accordingly, to obtain the same luminance over the whole area of the lamp, the second electrode 39 and the metal protrusions 33*b* are arranged more densely in the periphery of the flat type fluorescent lamp.

The supports 41 separate the first substrate 31 and second substrate 35 and maintain a predetermined distance between the substrates. For efficiency of discharge, the supports 41 may have various shapes. That is, in one embodiment of the present invention, the supports 41 may have a trapezoidal shape such that a contact area of the supports 41 with the second electrode 39 is greater than a contact area of the supports 41 with the barrier layer 43.

The reference numeral "41*a*" of FIG. 4 represents a side support that supports side portions of the first substrate 31 and the second substrate 35. The side support 41*a* is formed of the same material as that of either the first substrate 31 or second substrate 35.

A method for manufacturing the aforementioned flat type fluorescent lamp will now be described with reference to FIGS. 5A to 5E.

Figure 5A:
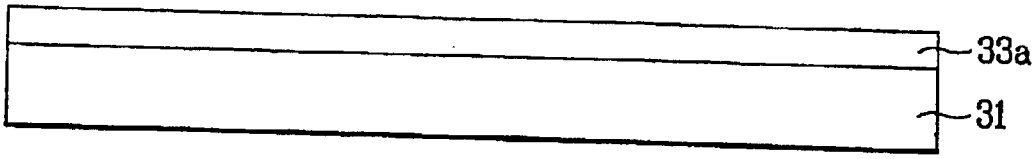
FIGS. 5A to 5E are sectional views illustrating process steps of manufacturing a flat type fluorescent lamp according to the present invention.

As shown in FIG. 5A, the first metal layer 33*a* is formed on the flat first substrate 31 of glass or heat-resistant material. At this time, the first metal layer 33*a* can be formed of any one of Ag, Cr, Pt, and Cu.

Figure 5B:
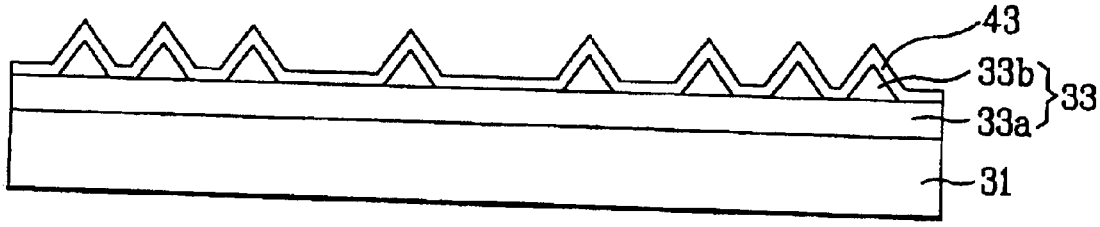

Subsequently, as shown in FIG. 5B, the pointed metal protrusions 33*b* are selectively formed on the first metal layer 33*a*. The metal protrusions 33*b* may have a trigonal pyramid shape and are formed by screen printing or photolithography process using exposure and developing processes. Alternatively, the first metal layer 33*a* and metal protrusions 33*b* are formed in an integral form with each other. At this time, the metal protrusions 33*b* are formed of the same type of material as that of the first metal layer 33*a*. The first metal layer 33*a* combined with the metal protrusions 33*b* form the first electrode 33 (typically, referred to as "cathode").

The metal protrusions 33*b* are formed on portions of the first metal layer 33*a* that correspond to areas of the second electrode 39 matrix that are directly over the first metal layer 33*a*. The metal protrusions 33*b* are formed more densely in the periphery of the first substrate 31 than the center of the first substrate 31 so that uniform luminance can be maintained over the whole area of the lamp.

Afterwards, the barrier layer 43 is formed on the metal protrusions 33*b* and the first metal layer 33*a*. The barrier layer 43 includes a material that is capable of serving as a barrier to sputtering during electron emission and at the same time capable of serving as an anti-reflecting coating layer. For example, the barrier layer 43 can be formed of any one of AlN, $BaTiO_3$, $SiN_x$, and $SiO_x$.

Figure 5C:
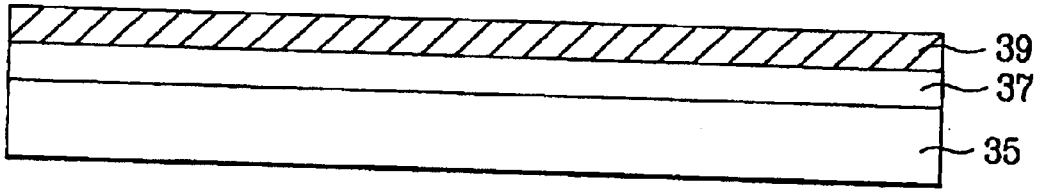

As shown in FIG. 5C, the phosphor layer 37 is formed on the flat second substrate 35 of glass or heat-resistant material. The second electrode 39 (typically, referred to as "anode") is arranged on the phosphor layer 37 as a matrix. At this time, the second electrode 39 is formed of the same type of material as the first electrode 33 and is arranged more densely in the periphery of the second substrate 35 than the center of the second substrate 35.

In the preferred embodiment of the present invention, after the first electrode 33 and the barrier layer 43 are formed on the first substrate 31, the second electrode 39 is formed on the second substrate 35. However, either one of the first and second substrates may be formed first.

Figure 5D:
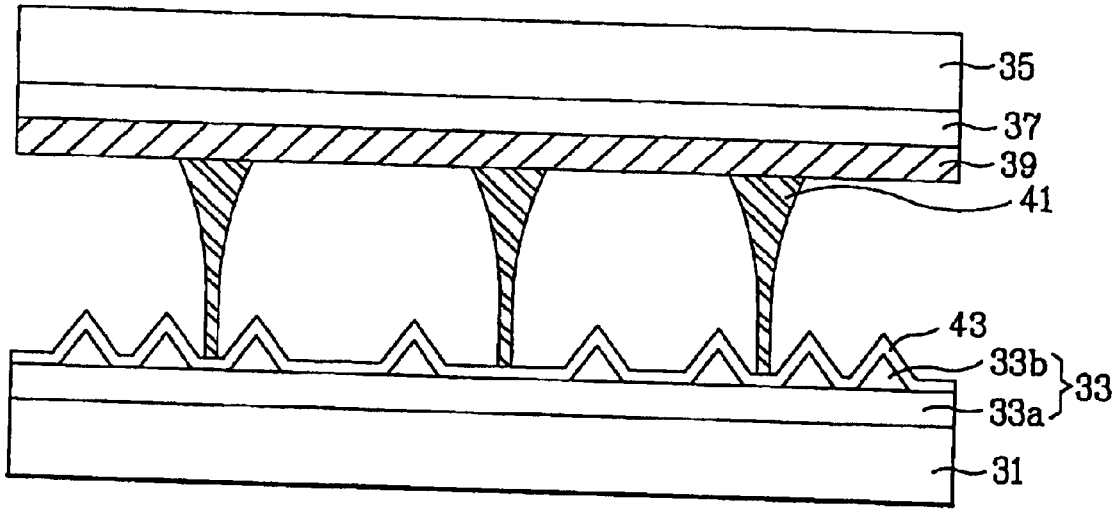

Subsequently, as shown in FIG. 5D, the supports 41 are selectively formed on the second electrode 39 to support the first substrate 31 and the second substrate 35. The supports 41 have a trapezoidal shape such that its contact area with the second electrode 39 is greater than that with the barrier layer 43. The reason why the supports 41 have a trapezoidal shape is to support the first substrate 31 and second substrate 35 while at the same time increasing luminance of light by controlling of the plasma between the first electrode 33 and the second electrode 39.

The supports 41 are typically formed of glass or quartz. The supports 41 are bonded to the first substrate 31 or the second substrate 35 by molding or injection. For stability of the supports 41, a glass paste may be added to a contact area between the supports 41 and the barrier layer 43 or the second electrode 39.

Figure 5E:
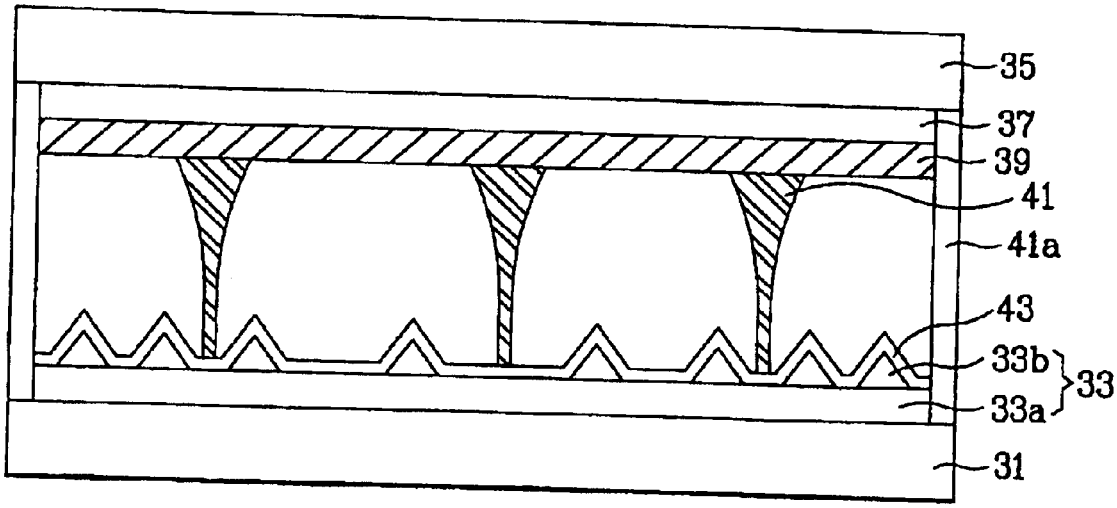

As shown in FIG. 5E, after the first substrate 31 is bonded to the second substrate 35 using the side support 41*a*, a phosphor gas is injected between the first and second substrates 31 and 35 through a gas injection hole (not shown). Then, the space between the first substrate 31 and the second substrate 35 is sealed.

Finally, a flexible printed circuit (FPC) is connected to the first electrode 33 of the first substrate 31 and to the second electrode 39 of the second substrate 35. The FPC is then soldered to the wiring of a connector assembly, so that the process for manufacturing the flat fluorescent lamp of the present invention is completed.

The flat type fluorescent lamp of the present invention can be used as an illuminating unit and also can be used a separate light source at the rear or front of a display device such as monitor, notebook PC, and TV.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A flat type florescent lamp comprising:

a first substrate and a second substrate;

a first electrode formed on the first substrate, the first electrode including a plurality of protrusions;

a phosphor layer formed on the second substrate;

a second electrode formed on the phosphor layer; and supports selectively formed between the first substrate and the second substrate, wherein the second electrode is formed on the second substrate as a matrix; and spaces in the matrix of the second electrode become greater toward the center of the second substrate.

2. The flat type fluorescent lamp of claim 1, wherein the first electrode includes:

a first metal layer formed on the entire surface of the first substrate; and the plurality of protrusions selectively formed on the first metal layer, the protrusions being made of metal.

3. The flat type fluorescent lamp of claim 2, wherein the metal of the first metal layer and the metal protrusions is any one of Ag, Cr, Pt, and Cu.

4. The flat type fluorescent lamp of claim 2, wherein the metal protrusions have a trigonal pyramid shape, a cone shape, or a quadrangular pyramid shape.

5. The flat type fluorescent lamp of claim 2, wherein the first metal layer and metal protrusions are formed in an integral form with each other to form the first electrode.

6. The flat type fluorescent lamp of claim 2, wherein the metal protrusions are formed on portions of the first metal layer that correspond to areas of the second electrode matrix that are directly over the first metal layer.

7. The flat type fluorescent lamp of claim 1, wherein the supports have a greater contact area adjacent to the second substrate than adjacent to the first substrate.

8. The flat type fluorescent lamp of claim 1, further comprising a barrier layer on the first electrode.

9. The flat type fluorescent lamp of claim 8, wherein the barrier layer is any one of AlN, $BaTiO_3$, $SiO_x$ and $SiN_x$.

10. The flat type fluorescent lamp of claim 1, wherein the supports have a trapezoidal shape.

11. The flat type fluorescent lamp of claim 1, wherein the first and second substrates are flat panels of glass or heat-resistant material.

12. The flat type fluorescent lamp of claim 1, wherein the first substrate includes a metal or an insulating material.

* * * * *